US006362643B1

(12) United States Patent
Kim

(10) Patent No.: US 6,362,643 B1
(45) **Date of Patent: *Mar. 26, 2002**

(54) APPARATUS AND METHOD FOR TESTING DRIVING CIRCUIT IN LIQUID CRYSTAL DISPLAY

(75) Inventor: Seong Gyun Kim, Seoul (KR)

(73) Assignee: LG. Philips LCD Co., LTD, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/458,822

(22) Filed: Dec. 13, 1999

Related U.S. Application Data

(63) Continuation of application No. 09/169,357, filed on Oct. 9, 1998, now Pat. No. 6,191,770.

(30) Foreign Application Priority Data

Dec. 11, 1997 (KR) ..... 97-67613
Dec. 11, 1998 (KR) ..... 98-54547

(51) Int. Cl.[7] ..... G09G 3/36

(52) U.S. Cl. ..... 324/770; 345/100; 345/87

(58) Field of Search ..... 324/158.1, 770; 345/87, 100

(56) References Cited

U.S. PATENT DOCUMENTS 6,191,770 B1 * 2/2001 Kim ..... 324/770

* cited by examiner

*Primary Examiner*—Glenn W. Brown
*Assistant Examiner*—Jimmy Nguyen
(74) *Attorney, Agent, or Firm*—Long Aldridge & Norman, LLP

(57) ABSTRACT

A driving circuit testing method that can quickly perform a test of a driving circuit in a liquid crystal display and repair defects thereof applies a test signal in parallel to a plurality of gate lines and a start signal to a first gate driving cell. The start signal and the test signal on the plurality of gate lines are latched into the plurality of gate driving cells. Then, the test signal is removed from the gate lines and the latched test signals latched into the plurality of gate driving cells are applied to the plurality of gate. Finally, an enable state in each gate line is detected to determine if one or more of the gate driving cells is defective.

27 Claims, 8 Drawing Sheets

APPARATUS AND METHOD FOR TESTING DRIVING CIRCUIT IN LIQUID CRYSTAL DISPLAY

This application is a continuation-in-part of U.S. patent application Ser. No. 09/169,357 filed Oct. 9, 1998 now U.S. Pat. No. 6,191,770 and also claims the benefit of Korean Patent Application No. 98-54547, filed on Dec. 11, 1998, which are each hereby incorporated by reference for all purposes as if fully set forth herein.

BACKGROUND OF THE INVENTION

1. Field of the Invention

The present invention relates to a liquid crystal display for displaying a picture on a liquid crystal panel, and more particularly to a method and apparatus for testing a liquid crystal panel driving circuit. Also, this invention is directed to a testing circuit for testing a pixel matrix driving circuit.

2. Discussion of the Related Art

Generally, a liquid crystal display apparatus displays a picture corresponding to video signals, such as television signals, on picture element (or pixel) matrices having pixels arranged at each intersection of a plurality gate lines and data lines. Each pixel consists of a liquid crystal cell for controlling a quantity of transmitted light in accordance with a voltage level of a data signal from the data line, and further consists of a thin film transistor (TFT) for switching the data signal to be transferred from the data line to the liquid crystal cell in response to a scan signal from the gate line. In order to drive the pixels, the liquid crystal display apparatus includes a data driving circuit for applying a data signal to each data line, and a gate driving circuit for applying a scan signal to the gate lines sequentially. These data driving circuit and gate driving circuit may have defects due to an error in the fabricating process. Typically, the liquid crystal display apparatus is provided with a redundant driving circuit used as a backup to a defective driving circuit.

For example, as shown in FIG. 1, the liquid crystal display apparatus provided with the redundant driving circuit includes a data driving circuit 4 connected to the data lines of a pixel matrix 2, a gate driving circuit 6 connected to the left terminals of the gate lines and a redundant gate driving circuit 8 that can be serially connected to the right terminals of the gate lines. The gate driving circuit 6 includes $1^{st}$ to $n^{th}$ gate driving cells GD1 to GDn that are connected to a start signal line SSL in series and to each of n gate lines. The first gate driving cell GD1 includes a shift register 10 and a buffer 12 which are serially connected between the start signal line SSL and the left terminal of the first gate line GL1, and the respective second to $n^{th}$ gate driving cells GD2 to GDn include a shift register 10 and a buffer 12 that are serially connected between two adjacent gate lines.

The gate driving cells GD1 to GDn are sequentially enabled as a start voltage signal Vst from the start signal line is shifted, thus, sequentially driving the gate lines GD1 to GLn. For example, the $k^{th}$ gate driving cell GDk drives the $k^{th}$ gate line GLk when a start voltage signal is applied from the $(k-1)^{th}$ gate driving cell. Likewise, the redundant gate driving circuit 8 includes $1^{st}$ to $n^{th}$ redundant gate driving cells GD1 to GDn that are serially connected to the start signal line SSL and, at the same time, connected to each of the n gate lines. The first redundant gate driving cell GD1 includes a shift register 10 and a buffer 12 which can be serially connected between the start signal line SSL and the right terminal of the first gate line GL1. The respective $2^{nd}$ to $n^{th}$ redundant gate driving cells RGD2 to RGDn include a shift register 10 and a buffer 12 that can be serially connected between two adjacent gate lines. The redundant gate driving cells RGD1 to RGDn drive the gate lines connected to the output terminals thereof when the start voltage signal Vst is shifted from the adjacent preceding gate lines. At this time, the first redundant gate driving cell RGD1 receives the start voltage signal Vst from the start signal line SSL. For example, when the $k^{th}$ gate driving cell GDk has defects, the $k^{th}$ redundant gate driving cell RGDk is connected between the $(k-1)^{th}$ gate line GL(k−1) and the $k^{th}$ date line GLk by a manufacturer during fabrication, thereby driving the $k^{th}$ gate line GLk when the start signal Vst is input from the $(k-1)^{th}$ gate line GLk.

The test of such liquid crystal display apparatus should not only be repeatedly performed depending on the number of defective gate driving cells, but also should be alternated with the repair of gate driving cells having defects. For example, in the liquid crystal display apparatus described above and shown in FIG. 1, the test should be repeated at least three times when the third and $(n-2)^{th}$ gate driving cells GD3 and GD)(n−2) have defects. At the time of the first test, only the first and second gate lines GL1 and GL2 driven with the first and second gate driving cells GD1 and GD2 appear to be normal; while all of the third to $n^{th}$ gate lines GD3 to GDn appear to be abnormal because of the defect in the third driving cell GD3. In other words, the $4^{th}$ to $n^{th}$ gate lines GD4 to GDn cannot be tested due to the defect in the third gate driving cell GD3. The second test is performed after the third redundant gate driving cell RGD3, instead of the third gate driving cell GD3, is set to the driving mode by the repair work of a manufacturer. At the time of the second test, tile first to $(n-3)^{th}$ gate lines GL1 to GL(n−3) appear to be normal, while the $(n-2)^{th}$ to $n^{th}$ gate lines GL(n−2) to GLn appear to be abnormal. In other words, the $(n-1)^{th}$ and $n^{th}$ gate lines G(Ln−1) and GLn cannot be tested because the $(n-2)^{th}$ gate driving cell GD(n−2) is not operating properly. The abnormality of these $(n-1)^{th}$ and $n^{th}$ gate lines GL(n−1) and GLn can be detected through the third test. The third test is carried out after the second repair work, in which the $(n-2)^{th}$ redundant gate driving cell RGD(n−2) instead of the $(n-2)^{th}$ gate driving cell GD(n−2) is set to the driving mode, has been terminated. In the third test, all the first to $n^{th}$ gate lines GL1 to GLn appear to be normal As described above, the conventional liquid crystal display apparatus provided with the redundant driving circuit was configured in such a manner that it was difficult to fully detect defects in the driving circuit with a single test. Because of this disadvantage in the conventional liquid crystal display apparatus provided with the redundant driving circuit, the testing and repairing work must be repeatedly performed depending on the number of defects in order to fully repair defects involved in the driving circuit. As a result, the conventional liquid crystal apparatus provided with the redundant driving circuit required a considerable amount of time for testing and repairing. Also, the conventional liquid crystal display apparatus provided with the redundant driving circuit is problematic to a manufacturer because of the repeated testing and repairing, depending on the number of defects.

SUMMARY OF THE INVENTION

Accordingly, to achieve these and other advantages and in accordance with the purpose of the present invention, as embodied and broadly described, the present invention is directed to an apparatus and method for testing driving circuits in a liquid crystal display that substantially obviates one or more of the problems due to limitations and disadvantages of the related art.

Accordingly, it is an object of the present invention to provide a method and apparatus for testing a driving circuit that is capable of performing a test of the driving circuit and a repair of defects in the driving circuit in a liquid crystal display.

In order to achieve this and other objects of the invention, a driving circuit testing method according to one aspect of the present invention includes a first step of applying a test signal to all the gate lines in parallel; a second step of applying the start signal to a first gate driving cell in the plurality of gate driving cells; a third step of allowing the signals to be latched into each gate driving cell; a fourth step of replacing the test signal being applied to the plurality of gate lines with the signals latched into the plurality of gate driving cells; and a fifth step of testing an enable state in each gate line.

A driving circuit testing method according to another aspect of the present invention includes a first step of applying a test signal to all the gate lines in parallel; a second step of applying the start signal to a first gate driving cell in the plurality of gate driving cells; a third step of allowing the signals to be latched into the odd-numbered or even-numbered gate driving cells in the plurality of gate driving cells; a fourth step of replacing testing signal with the signals latched into the odd-numbered or even-numbered gate driving cells; and a fifth step of testing an enable state in each gate line connected to the odd-numbered or even-numbered gate driving cells.

A driving circuit testing apparatus to still another aspect of the present invention includes means for applying a test signal to all the gate lines in parallel; means for applying the start signal to a first gate driving cell in the plurality of gate driving cells; latching control means for allowing the signals to be latched into each gate driving cell; signal switching means for replacing the test signal being applied to the plurality of gate lines with the signals latched into the plurality of gate driving cells; and detecting means for detecting an enable state in each gate line.

A driving circuit testing apparatus to still another aspect of the present invention includes means for applying a test signal to all the gate lines in parallel; means for applying the start signal to a first gate driving cell in the plurality of gate driving cells; latching control means for allowing the signals to be latched into the odd-numbered or even-numbered gate driving cells; signal switching means for replacing the testing signal with the signals latched into the odd-numbered or even-numbered gate driving cells; and detecting means for detecting an enable state in each gate line connected to the odd-numbered or even-numbered gate driving cells.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
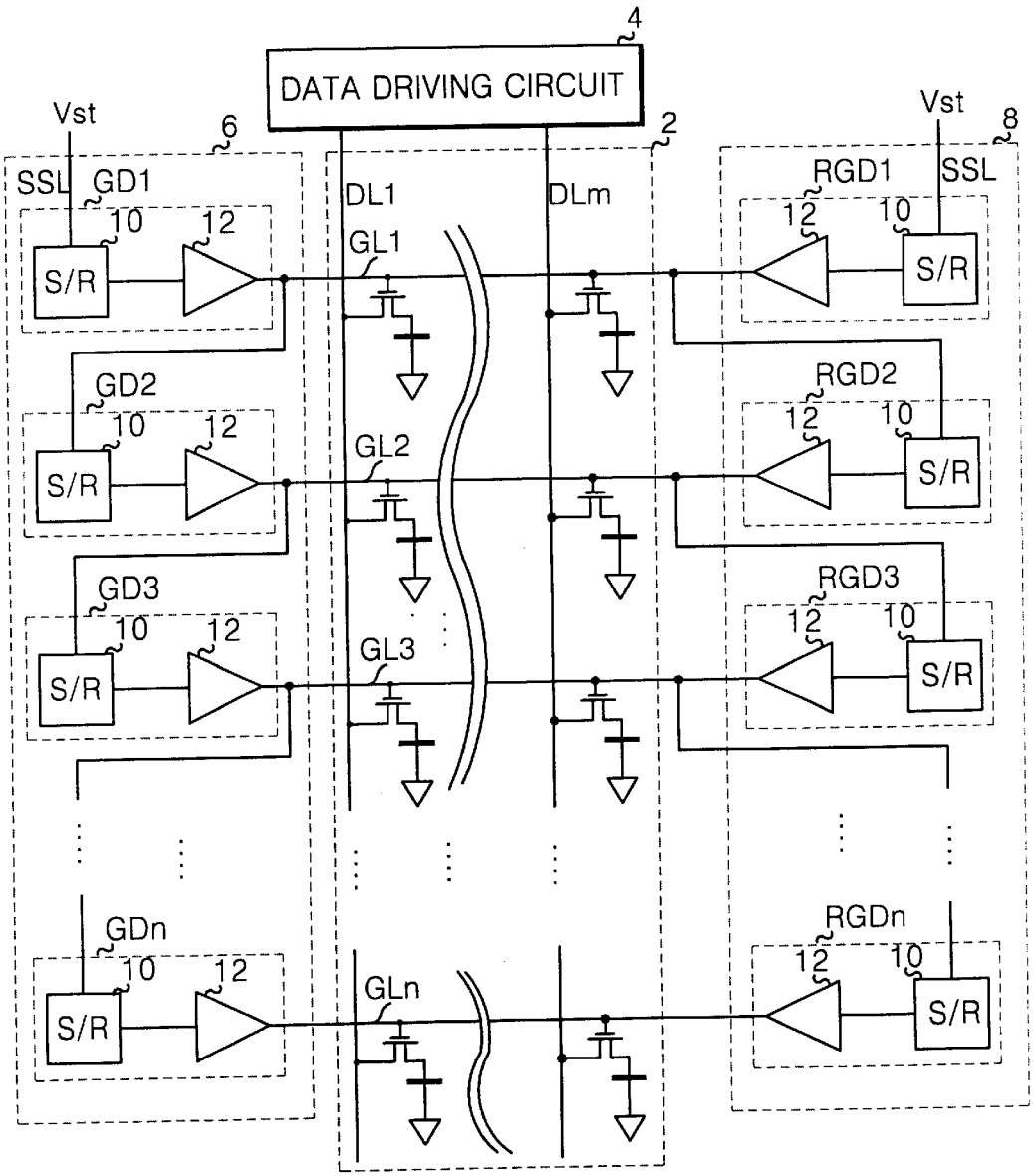
FIG. 1 PRIOR ART
FIG. 1 is a schematic view of a conventional liquid crystal display apparatus.
Figure 2:
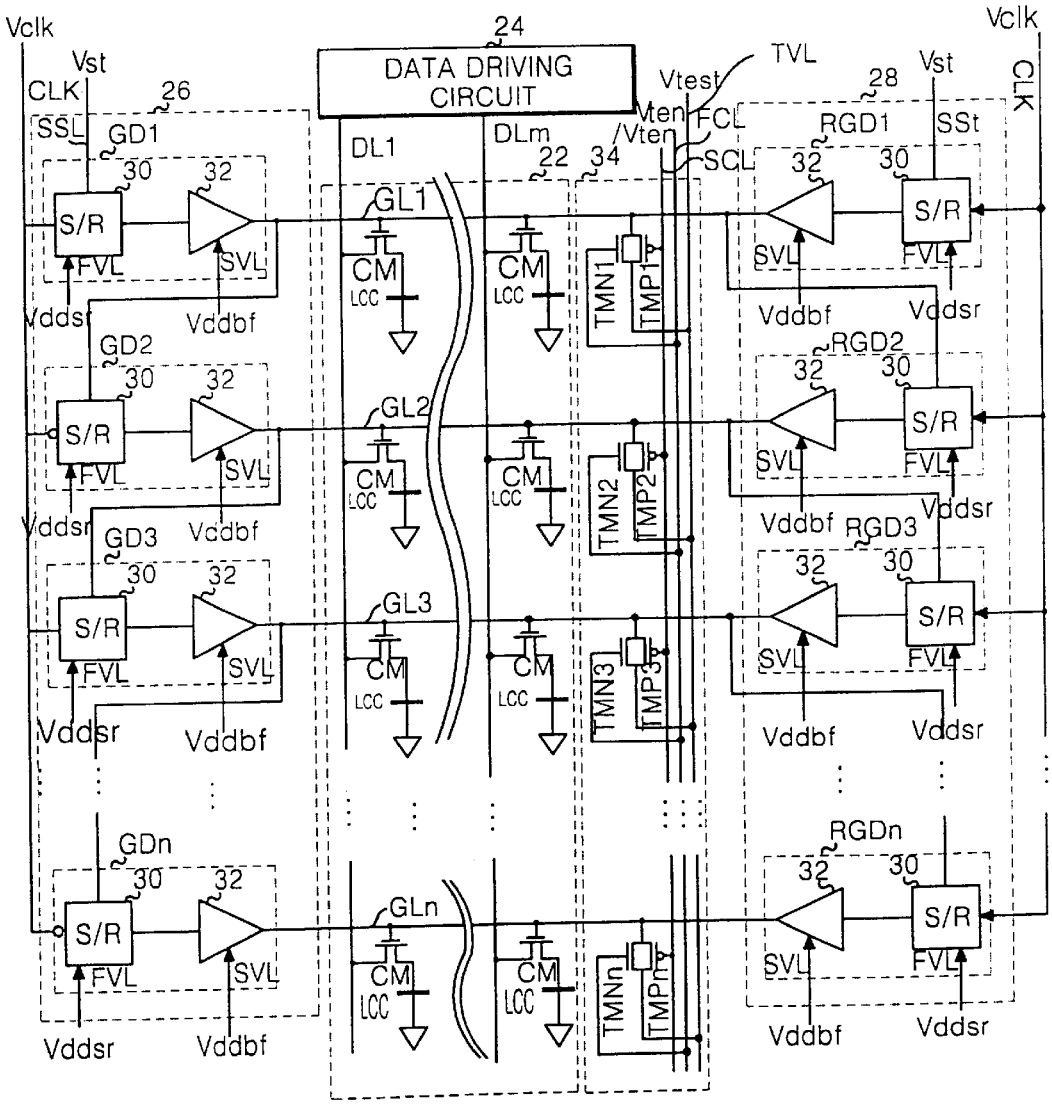
FIG. 2 is a schematic view of a liquid crystal display apparatus employing a driving circuit testing apparatus according to a preferred embodiment of the present invention.

Referring to FIG. 2, there is shown a liquid crystal display employing a driving circuit testing apparatus according to a preferred embodiment of the present invention. As shown in FIG. 2, the liquid crystal display includes a data driving circuit 24 connected to data lines DL1 to DLn of a pixel matrix 22, a gate driving circuit 26 connected to the left terminals of gate lines GL1 to GLn, and a redundant gate driving circuit 28 connected to the right terminals of the gate lines GL1 to GLn. A TFT cell CM and a liquid crystal cell LCC are arranged in each intersection point in which the data lines DL1 to DLn intersect with the gate lines GL1 to GLn. Each liquid crystal cell LCC displays a picture by controlling the light transmissivity in accordance with a voltage level of a data signal from the data line DL. Each TFT cell CM switches the data signal to be transferred from the data line DL to the liquid crystal cell LCC in response to a signal from the gate line GL. The data driving circuit 24 applies a data signal to each data line DL1 to DLm in every horizontal period.

The gate driving circuit 26 includes $1^{st}$ to $n^{th}$ gate driving cells GD1 to GDn that are connected to a start signal line SSL in series and to each of the n gate lines GL1 to GLn. The first gate driving cell GD1 includes a shift register 30 and a buffer 32 that are serially connected between the start line SSL and the first gate line GL1. The respective second through, $n^{th}$ gate driving cells GD2 and GDn each include a shift register 30 and a buffer 32 which are connected in series between two adjacent gate lines.

The gate driving cells GD1 to GDn are sequentially enabled as a start voltage signal Vst from the start signal line SSL is shifted, thus sequentially driving the n gate lines GL1 to GLn. For example, the $k^{th}$ gate driving cell GDk drives the $k^{th}$ gate line GLk when the start voltage signal is applied from $(k-1)^{th}$ gate driving cell GD(k−1). To this end, the shift register 30 included in each odd-numbered gate driving cell GD1, GD3, . . . , GD(n−1) latches a signal from the start line SSL or the adjacent upper gate line GL2, GL4, . . . , GL(n−2), respectively, on the rising edge of a clock signal Vclk from a clock line CLK.

On the other hand, the shift register 30 included in each even-numbered gate driving cell GD2, GD4, . . . , GD(n−2) or GDn latches a signal from the start line SSL or the adjacent upper gate line GL1, GL3, . . . , GL(n−2) or GL(n−1), respectively, on the falling edge of the clock signal Vclk from a clock line CLK. Further, each shift resister 30 is driven during an interval when a shift register drive voltage Vddsr is applied.

In order to sequentially shift the start signal Vst along the shift registers 30 included in the gate driving cells GD2 to GDn, the clock signal Vclk changes from a high logic level to a low logic level or vice versa in every horizontal scanning interval. The buffer 32 included in each gate driving cell GD1 to GDn provides buffered signals from the shift register 30 to the gate line GL. The buffer 32 included in each gate driving cells GD1 to GDn performs such a buffering operation during an interval when a buffer driving voltage Vddbf is applied from the second driving voltage line SVL.

The redundant gate driving circuit 28 includes $1^{st}$ to $n^{th}$ redundant gate driving cells RGD1 to RGDn that are serially connected to the start signal line SSL and, at the same time, connected to each of the n gate lines. The first redundant gate driving cell GD1 includes a shift register 30 and a buffer 32 which are serially connected between the start signal line SSL and the right terminal of the first gate line GL1, and the respective $2^{nd}$ to $n^{th}$ redundant gate driving cells RGD2 to RGDn include a shift register 30 and a buffer 32 that are serially connected between two adjacent gate lines. Each one of the redundant gate driving cells RGD1 to RGDn is connected instead of the gate driving cells GD1 to GDn between two gate lines, instead of the gate driving cells GD1 to GDn when the corresponding gate driving cells GD1 to GDn have defects. Further, each redundant gate driving cell RGD1 to RGDn drives a gate line connected to the output terminal thereof in accordance with a voltage signal at the adjacent preceding gate line.

At this time, the first redundant gate driving cell RGD1 receives the start voltage signal Vst from the start signal line SSL. For example, when the $k^{th}$ gate driving cell GDk has defects, the $k^{th}$ redundant gate driving cell RGDk is connected between the $(k-1)^{th}$ gate line GL(k−1) and the $k^{th}$ date line GLk by a manufacturer, hence driving the $k^{th}$ gate line GLk when the start signal Vst is input from the $(k-1)^{th}$ gate line GL(k−1). The shift registers 30 and the buffers 32 included in each redundant gate driving cell RGD1 to RGDn are driven with the shift register driving voltage Vddsr from the first driving voltage line FVL and the buffer driving voltage Vddbf from the second driving voltage line SVL.

The liquid crystal display apparatus of the present invention includes a test voltage source 34 connected to the right terminals of the gate lines GD1 to GDn. This test voltage source 34 switches a test voltage Vtest to be delivered from a test voltage line TVL to the gate lines GD1 to GDn in response to the first and second test control signals Vten and Vten from the first and second control lines FCL and SCL. To this end, the test voltage source 34 includes n NMOS TFTs TMN1 to TMNn connected to the test voltage line TVL and to each gate line GL1 to GLn, and n PMOS TFTs TMP1 to TMPn connected in parallel to each of the NMOS TFTs TMN1 to TMNn. The n NMOS TFTs TMN1 to TMNn are simultaneously turned on during an interval when a high logic level first control signal Vten is applied from the first control line FCL, thereby transferring the test voltage Vtest from the test voltage line TVL to the n gate lines GL1 to GLn. The first control signal Vten remains at a high logic level during a certain interval when the liquid crystal display apparatus is tested.

The n PMOS TFTs TMP1 to TMPn are preferably simultaneously turned on during an interval when the second control signal/Vten from the second control line SCL remains at a low logic level, thereby transferring the test voltage Vtest from the test voltage line TVL to the gate line GL. The second control signal /Vten has a waveform opposite to the first control signal Vten. In other words, the n PMOS TFTs TMP1 to TMPn are turned on simultaneously with the n NMOS TFTs TMN1 to TMNn to increase a current amount supplied to each gate line GL1 to GLn. As a result, even though a number of gate driving cells in the gate driving circuit 26 have defects, any abnormalities of the gate driving cells GD1 to GDn can be simultaneously detected. In other words, the test of driving circuit is completed in a single test procedure.

The driving circuit test is preferably divided into an odd mode for detecting an abnormality in each odd-numbered gate driving cell GD1, GD3,. . . , GD(n−1) and an even mode for detecting an abnormality in each even-numbered gate driving cell GD2, GD4, . . . , GDin. This is caused by the fact that the shift registers 30 included in each odd-numbered gate driving cell GD1, GD3, . . . , GD(n−1) perform a latching operation on a rising edge of the clock signal, while the shift registers 30 included in each even-numbered gate driving cell GD2, GD4, . . . , GDn perform a latching operation on a falling edge of the clock signal, When all of the n gate driving cells GD1 to GDn include the shift registers 30 performing the latching operation on either the rising edge or the falling edge, the abnormalities of the n gate driving cells GD1 to GDn are simultaneously detected. Further, n shift registers 30 commonly connected to the first driving voltage line FVL are driven earlier than the n buffers 32 commonly connected to the second driving voltage line SVL by means of the shift register driving voltage Vddsr being supplied earlier than the buffer driving voltage Vddbf at the time of testing. The n buffers 32 are driven with the buffer driving voltage Vddbf from the second driving voltage line SVL after the n NMOS TFTs TMN1 to TMNn and the n PMOS TFTs TMP1 to TMPn were turned off. At this time, all the n gate lines GL1 to GLn are enabled by means of output signals of the n shift registers 30 buffered with each of the n buffers 32. However, the gate lines GL connected to the gate driving cells GD having defects in any one of the shift register 30 and the buffer 32 are disabled. The gate driving cells GD having defects can be simultaneously detected through such a testing process. Also, all of the gate diving cells GD having defects can be replaced at the same time with the redundant gate driving cells RGD during a repair process. The test voltage line TVL included in the test voltage source 34 serves to transfer the test voltage Vtest from the test power supply, not shown, to the gate lines GL1 to GLn at the time of testing the driving circuit, while serving to prevent static electricity by connecting the gate lines GL1 to GLn to the ground GND, not shown, in the other case.

Figure 3:
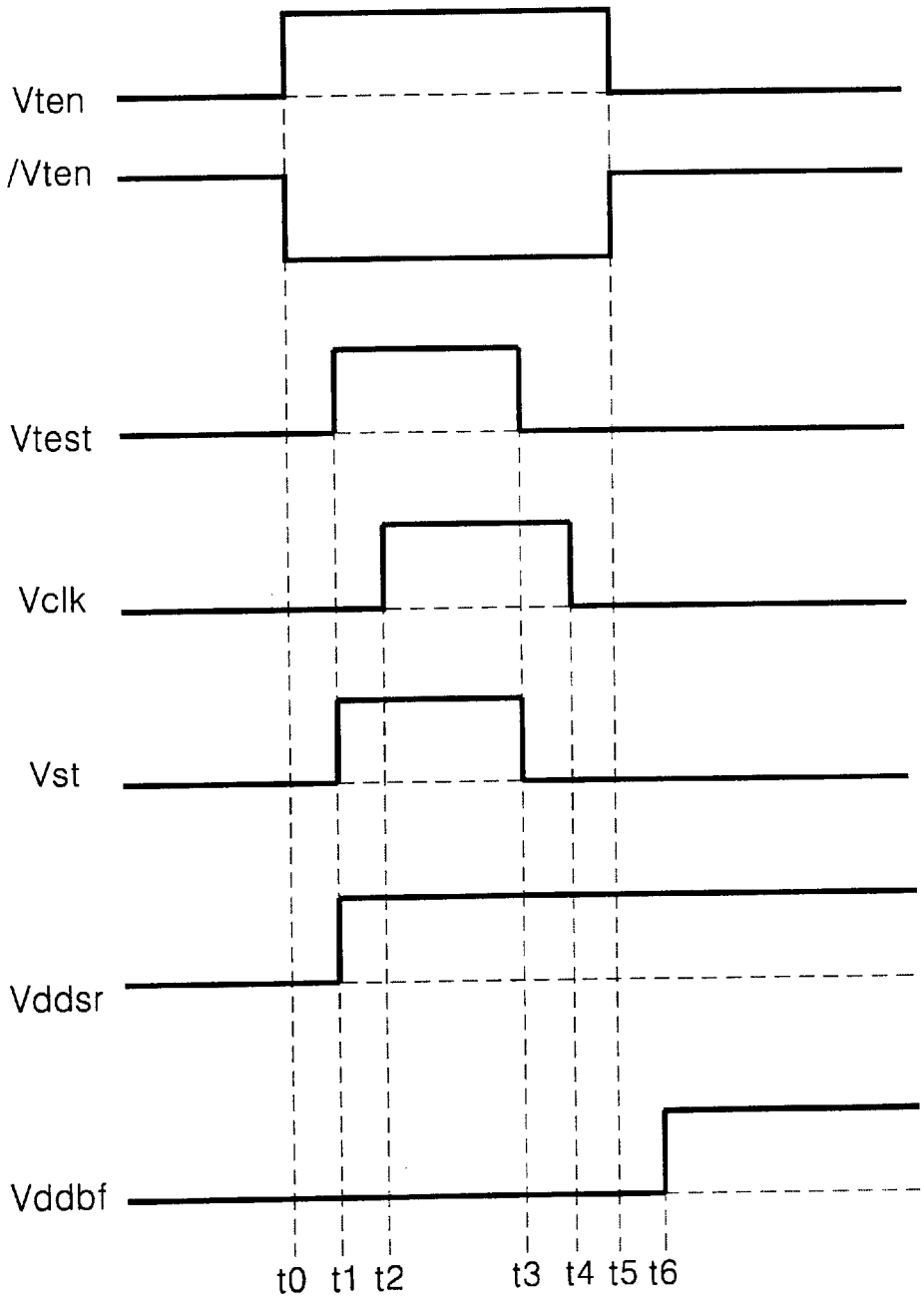
FIG. 3 is an operational waveform diagram of each part of the circuits shown in FIG. 2 when the odd-numbered gate driving cells are tested.

FIG. 3 is a timing chart of signals applied to each part of the liquid crystal display apparatus in FIG. 2 when the odd-numbered gate driving cells GD1, GD3, . . . , GD(n−1) are being tested, At t0 the first control signal Vten applied to the gate of NMOS TFTs TMN1 to TMNn changes from a low logic level to a high logic level while the second control signal /Vten changes from a high logic level to a low logic level. Accordingly, all of the NMOS TFTs TMN1 to TMNn and the PMOS TFTs TMP1 to TMPn are turned on to thereby connect n gate lines GL1 to GLn to the test voltage line TVL. Next, at t1, a test voltage Vtest is applied to the test voltage line TVL, a start signal Vst to the start signal line SSL, and a shift register driving voltage Vddsr to n shift registers 30 included in the n gate driving cells GD1 to GDn. The n shift registers 30 included in the first to $n^{th}$ gate driving cells GD1 to GDn enter the driving mode. Also, the test voltage Vtest on the test voltage line TVL is applied, via the n NMOS TFTs TMNT1 to TMNn and the n PMOS TFTs TMP1 to TMPn, to n gate lines GL1 to GLn. Accordingly, the start signal Vst is applied to the shift register 30 in the first gate driving cell GD1, and the test voltage Vtest on the test voltage line TVL is applied, via (n−1) gate lines GL1 to GL(n−1), to (n−1) shift registers 30 included in each of the second to $n^{th}$ gate driving cells GD2 to GDn. A clock signal Vclk applied to the clock line CLK changes from a low logic level to a high logic level at t2. The odd-numbered gate driving cells GD1, GD3, . . . , GD(n−1) latch the start signal Vst or the test voltage Vtest into the buffers 32 using the clock signal Vclk.

At t3, the start signal Vst changes to a low logic level and the test voltage Vtest on the test voltage line TVL is turned off. At t4, the clock signal Vclk on the clock line CKL changes to a low logic level. At t5, the first control signal Vten changes from a high logic level to a low logic level while the second control signal /Vten changes from a low logic level to a high logic level. A buffer driving voltage Vddbf is then applied, via the second driving voltage line SVL, to the buffers 32 included in each gate driving cell GD1 to GDn. At this time, all the buffers 32 included in each gate driving cell GD1 to GDn enter the driving mode. The buffers 32 included in the odd-numbered gate driving cells GD1, GD3, . . . , GD(n−1) charge the output signals of the shift registers 30 latching the start signal Vst or the test voltage Vtest to the odd-numbered gate lines GL1, GL3, . . . , GL(n−1). As a result, the pixels connected to the odd-numbered gate lines GL1, GL3, . . . , GL(n−1) are driven. At this time, a tester probes the voltage levels on the odd-numbered gate lines GL1, GL3, . . . , GL(n−1) thereby detecting if any abnormality exists for each odd-numbered gate driving cell GD1, GD3, . . . , GD(n−1). Alternatively, a tester may detect an abnormality of each odd-numbered gate driving cell GD1, GD3, . . . , GD(n−1) using a non-probing method, such as an electro-optical method.

Figure 4:
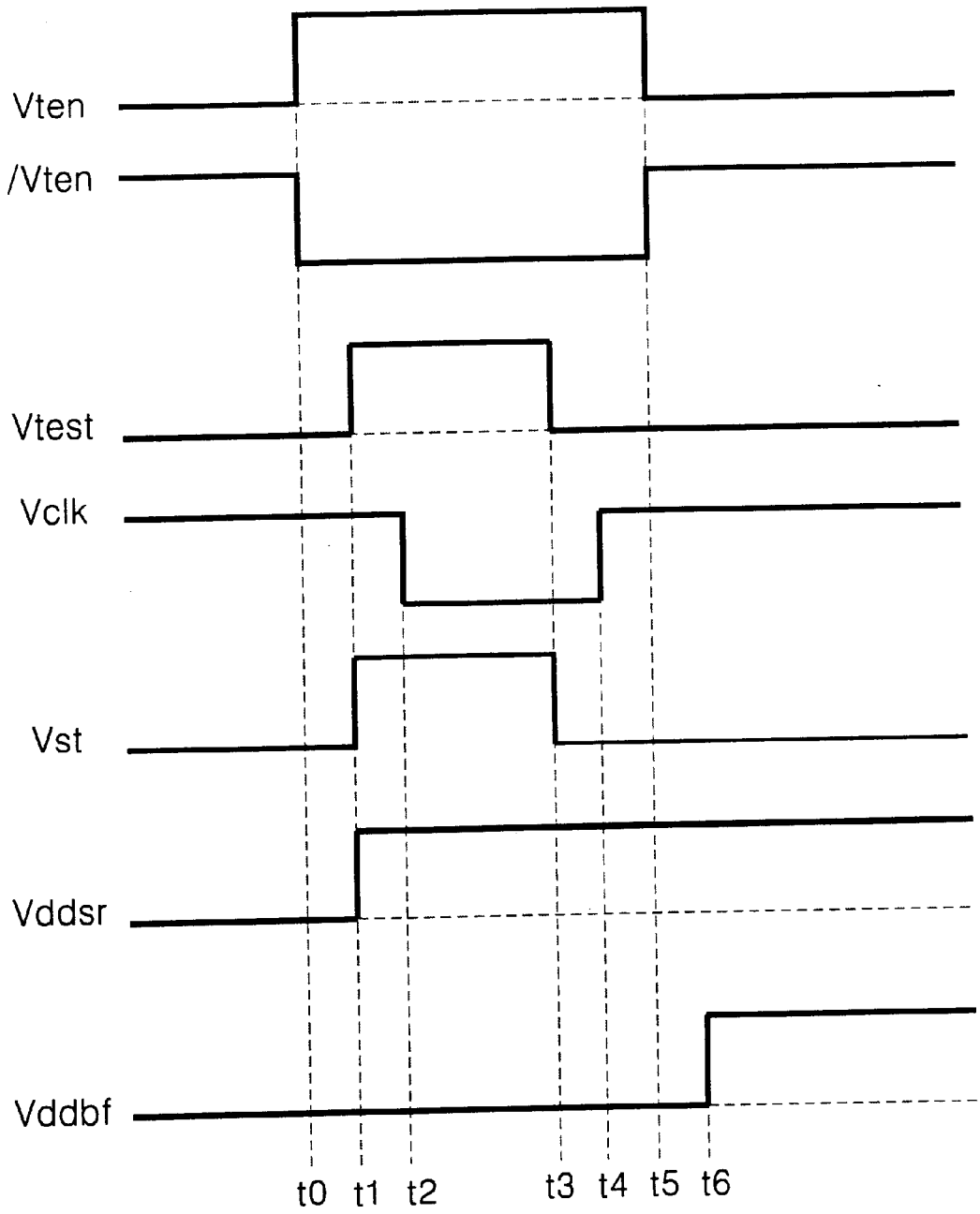
FIG. 4 is an operational waveform diagram of each part of the circuits shown in FIG. 2 when the even-numbered gate driving cells are tested.

FIG. 4 is a timing chart of signals applied to each part of the liquid crystal display apparatus in FIG. 2 when even-numbered gate driving cells GD2, GD4, . . . , GDn are being tested. At t0, the first control signal Vten applied to the gates of NMOS TFTs TMN1 to TMNn changes from a low logic level to a high logic level while the second control signal /Vten changes from a high logic level to a low logic level. Accordingly, all of the NMOS TFTs TMN1 to TMNn and the PMOS TFTs TMP1 to TMPn are turned on to thereby connect n gate lines GL1 to GLn to the test voltage line TVL. Next, at t1, a test voltage Vtest is applied to the test voltage line TVL, a start signal Vst is applied to the start signal line SSL, and a shift register driving voltage Vddsr is applied to n shift registers 30 included in the n gate driving cells GD1 to GDn. The n shift registers 30 included in the first to $n^{th}$ gate driving cells GD1 to GDn enter the driving mode. Also, the test voltage Vtest on the test voltage line TVL is applied, via the n NMOS TFTs TMN1 to TMNn and the n PMOS TFTs TMP1 to TMPn, to n gate lines GL1 to GLn. Accordingly, the test voltage Vtest on the test voltage line TVL is applied, via (n−1) gate lines GL1 to GL(n−1), to (n−1) shift registers 30 included in each of the second to $n^{th}$ gate driving cells GD2 to GDn. A clock signal Vclk applied to the clock line CLK changes from a high logic level to a low logic level at t2. The even-numbered gate driving cells GD2, GD4, . . . , GDn latch the test voltage Vtest into the buffers 32 using the clock signal Vclk.

At t3, the test voltage Vtest on the test voltage line TVL is turned off, Further, at t4, the clock signal Vclk on the clock line CLK changes from a low logic level to a high logic level. At t5, the first control signal Vten changes from a high logic level to a low logic level while the second control signal /Vten changes from a low logic level to a high logic level.

A buffer driving voltage Vddbf is then applied, via the second driving voltage line SVL, to the buffers 32 included in each gate driving cell GD1 to GDn. At this time, all the buffers 32 included in each gate driving cell GD1 to GDn enter the driving mode. The buffers 32 included in the even-numbered gate driving cells GD2, GD4, . . . , GDn charge the output signals of the shift registers 30, latching the test voltage Vtest to the even-numbered gate lines GL2, GL4, . . . , GLn. As a result, the pixels connected to the even-numbered gate lines GL2, GL4, . . . ,GLn are driven. At this time, a tester probes voltage levels on the even-numbered gate lines GL2, GL4, . . . , GLn, thereby detecting any abnormalities of each odd-numbered gate driving cell GD2, GD4, . . . , GDn. The abnormalities of each gate driving cell can be simultaneously detected using the testing process as described. Accordingly, the testing time for the driving circuit is reduced.

The gate driving cells GD detected to be abnormal through such a testing process can be repaired at the same time with the redundant gate driving cells RGD. For example, as a result of testing, when the second and $(n-1)^{th}$ gate driving cells GD2 and GD(n−1) are detected to be abnormal, the second redundant gate driving cell RGD2 is connected instead of the second gate driving cell GD2 between the first gate line GL1 and the second gate line GL2. In addition, the $(n-1)^{th}$ redundant gate driving cell RGD(n−1) is connected instead of the $(n-1)^{th}$ gate driving cell GD(n−1) between the $(n-2)^{th}$ gate line GL(n−2) and the $(n-1)^{th}$ gate line GL(n−1), thereby, substantially concurrently repairing the second and $(n-1)^{th}$ gate driving cells GD2 and GD(n−1). Accordingly, the time required for the repair work is substantially reduced.

Figure 5:
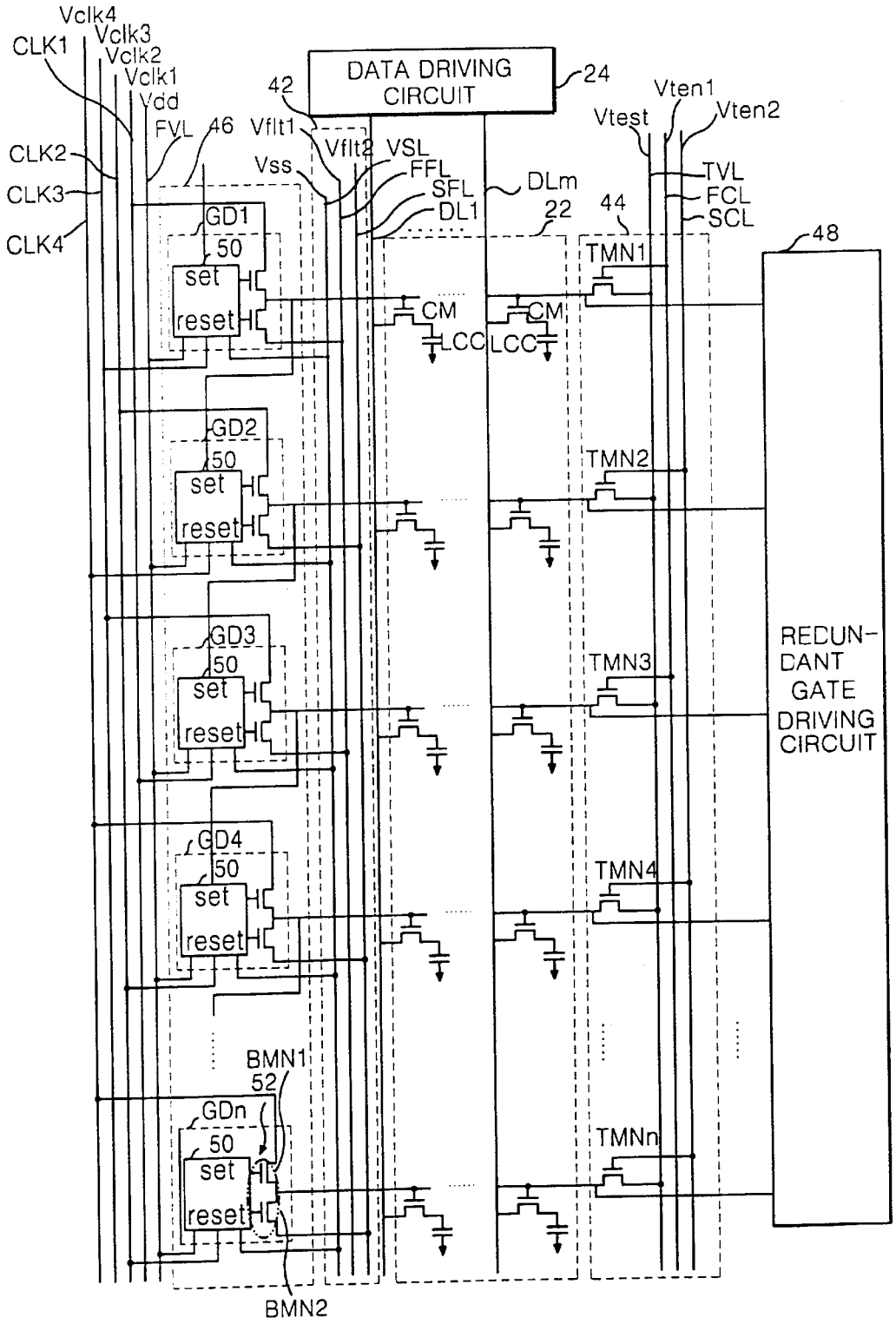
FIG. 5 is a schematic view of a liquid crystal display apparatus employing a driving circuit testing apparatus according to another preferred embodiment of the present invention.

FIG. 5 illustrates a liquid crystal display employing a driving circuit testing apparatus according to another embodiment of the present invention. The liquid crystal display has a gate driving circuit consisting of NMOS transistors and/or PMOS transistors. The gate driving circuit responds to 4-phase clocks to drive gate lines on a liquid crystal panel. The liquid crystal display includes a driving circuit testing apparatus for detecting an abnormality in the gate lines. To this end, the driving circuit testing apparatus responds to 4-phase clocks and drives the gate lines on the liquid crystal panel in such a manner as to divide them into odd and even numbered lines. As shown in FIG. 5, the liquid crystal display includes a data driving circuit 24 connected to data lines DL1 to DLm of a pixel matrix 22, a gate driving circuit 46 connected to the left terminals of gate lines GL1 to GLn, and a redundant gate driving circuit 48 connected to the right terminals of the gate lines GL1 to GLn. The pixel matrix 22 and the data driving circuit 24 are the same as in FIG. 2 in label and function. Therefore, a description of the pixel matrix 22 and the data driving circuit 24 will not be repeated here.

The gate driving circuit 46 includes $1^{st}$ to $n^{th}$ gate driving cells GD1 to GDn that are connected to a start signal line SSL in series and to each of the n gate lines GL1 to GLn. The first gate driving cell GD1 consists of a shift stage 50 and a buffer 52 which are serially connected between the start signal line SSL and the left terminal of the first gate line GL1. The respective second through $n^{th}$ gate driving cells GD2 through GDn each include a shift stage 50 and a buffer 52 which are connected in series between two adjacent gate lines. The n shift stages 50 are commonly connected to a driving voltage line FVL. Each shift stage 50 is driven when a driving voltage Vdd on the driving voltage line FVL has a high level. The respective buffers 52 each consist of two NMOS TFTs BMN1 and BMN2 each having a gate electrode connected to on output terminal of the shift stage 50.

The first gate driving cell GD1 among the odd-numbered gate driving cells GD1, GD3,. . . , GD(n−1) is set-up by a start voltage signal Vst from the start signal line SSL to enable the first gate line GL1, and the third to $(n-1)^{th}$ gate driving cells GD3,. . . , GD(n−1) are respectively set-up by the start voltage signals from the even-numbered gate lines GL2,. . . , GL(n−2) to enable the third to $(n-1)^{th}$ gate lines GL3, . . . , GL(n−1). To this end, each shift stage 50 included in the $(4k-3)^{th}$ gate driving cells GD1, GD5, . . . , GD(n−3) is set-up by the start signal from the start signal line SSL or $(4k)^{th}$ gate line GLA, GL8, . . . , GLn to turn-on the NMOS TFT BMN1 of the $(4k-3)^{th}$ buffer 52. The NMOS TFT BMN1 of each of the $(4k-3)^{th}$ buffers applies a first clock signal Vclk1 from a first clock line CLK1 to each of the $(4k-3)^{th}$ gate lines GL1, GL5, . . . , GLn−3. The shift stages 50 included in the $(4k-1)^{th}$ gate driving cells GD3, GD7, . . . , GD(n−1) are set-up by the start signals from the $(4k-2)^{th}$ gate lines GL2, GL6, . . . , GL(n−2) to turn-on the NMOS TFTs BMN1 of the $(4k-11)^{th}$ buffers 52, respectively. The NMOS TFT BMN1 of the $(4k-1)^{th}$ buffer 52 supplies a third clock signal Vclk3 from a third clock line CLK3 to the $(4k-1)^{th}$ gate lines GL3, GL7, . . . , GL(n−1). Each shift stage 50 included in the $(4k-3)^{th}$ gate driving cells GD1, GD5, . . . , GD(n−3) is reset by the third clock signal Vclk3 from the third clock line CLK3 to turn-on the NMOS TFT BMN2 of the $(4k-3)^{th}$ buffer 52. The NMOS TFT BMN2 of the $(4k-3)^{th}$ buffer discharges the start signal on the $(4k-3)^{th}$ gate line toward a first floating voltage line FFL. The shift stages 50 included in the $(4k-1)^{th}$ gate driving cells GD3, GD7, . . . , GD(n−1) are reset by the first clock signal Vclk1 from the first clock line CLK1 to turn-on the NMOS TFTs BMN2 of the $(4k-1)^{th}$ buffers 52, respectively. The NMOS TFT BMN2 of the $(4k-1)^{th}$ buffer 52 discharges the start signal on the $(4k-1)^{th}$ gate line toward the first floating voltage line FFL.

The even-numbered gate driving cells GD2, GD4, . . . , GDn are respectively set-up by the start voltage signals from the odd-numbered gate lines GL1, GL3, . . . , GL(n−1) to enable the even gate lines GL2, GL4, . . . , GLn. To this end, each shift stage 50 included in the $(4k-2)^{th}$ gate driving cells GD2, GD6, . . . , GD(n−2) is set-up by the start signal from the $(4k-3)^{th}$ gate line GL1, GL5, . . . , GL(n−3) to turn-on the NMOS TFT BMN1 of the $(4k-2)^{th}$ buffer 52. The NMOS TFT BMN1 of the $(4k-2)^{th}$ buffer applies a second clock signal Vclk2 from a second clock line CLK2 to the $(4k-2)^{th}$ gate line GL2, GL6, . . . , GL(n−2). The shift stages 50 included in the $(4k)^{th}$ gate driving cells GD4, GD8, . . . , GDn are set-up by the start signals from the $(4k-1)^{th}$ gate line GL3, GL7, . . . , GL(n−1) to turn-on the NMOS TFTs BMN1 of the $(4k)^{th}$ buffers 52, respectively. The NMOS TFT BMN1 of the $(4k)^{th}$ buffer 52 supplies a fourth clock signal Vclk4 from a fourth clock line CLK4 to the $(4k)^{th}$ gate line GL4, GL8, . . . , GLn. Also, each shift stage 50 included in the $(4k-2)^{th}$ gate driving cells GD2, GD6 . . . , GD(n−2) is reset by the fourth clock signal Vck4 from the fourth clock line CKL4 to turn-on the NMOS TFT NM2 of the $(4k-2)^{th}$ buffer 52. Each NMOS TFT NM2 of the $(4k-2)^{th}$ buffer 52 discharges the start signal on the $(4k-2)^{th}$ gate line GL2, GL6, . . . , GL(n−2) toward a second floating voltage line SFL. The shift stages 50 included in the $(4k)^{th}$ gate driving cells GD4, GD8, . . . , GDn are reset by the second clock signal Vclk2 from the second clock line CLK2 to turn-on the NMOS TFTs BMN2 of the $(4k)^{th}$ buffers 52, respectively. The NMOS TFTs BMN2 of the $(4k)^{th}$ buffers 52 discharge the start signal on the $(4k)^{th}$ gate line GL4, GL8, . . . , GLn toward a second floating voltage line SFL.

The redundant gate driving circuit 48 includes n redundant gate driving cells (not shown) that are provided for each of the n gate lines in a connectable state. Each redundant gate driving cell consists of a shift stage being set-up by the start signal from an adjacent proceeding gate line and a buffer for buffering a signal to be transmitted from the shift stage to a gate line GL, the same as the gate driving cell GD. When one or more gate driving cells GD1 to GDn have defects, a corresponding one of the redundant gate driving cells is connected between two gate lines GL instead of the gate driving cell(s) having defects.

The liquid crystal display apparatus of the present invention includes a level maintaining voltage source 42 connected to the gate driving circuit 46 and a test voltage source 44 connected to the right terminals of the gate lines GD1 to GDn. The level maintaining voltage source 42 maintains the voltage signals on the even-numbered gate lines GL2, GLA, . . . , GLn at a high level when the odd-numbered gate lines GL1, GL3, . . . , GL(n−1) are tested, thereby allowing the odd-numbered gate driving cells GD1, GD3, . . . , GD(n−1) to be set-up. When the even-numbered gate lines GL2, GL4, . . . , GLn are tested, the level maintaining voltage source 42 maintains the voltage signals on the odd-numbered gate lines GL1, GL3, . . . , GL(n−1) at a high level so as to allow the odd-numbered gate driving cells GD1, GD3, . . . , GD(n−1) to be set-up. To this end, the level maintaining voltage source 42 has a ground voltage line VSL, a driving voltage line FVL, a first floating voltage line FFL and a second floating voltage line SFL. The ground voltage line VSL is connected to the n shift stages 50 and applies commonly a ground voltage GND to the n shift stages 50. The driving voltage line FVL is commonly connected to the n shift stages 50 and supplies the driving voltage to the n shift stages 50. The first floating voltage line FFL supplies the first floating voltage Vflt1 maintaining a high voltage level on the odd-numbered gate lines GL1, GL3, . . . , GL(n−1) when the even-numbered gate driving cells GD2, GD4, . . . , GDn are tested. To this end, the first floating voltage line FFL is commonly connected to the source electrodes of the NMOS TFTs BMN2 included respectively in the buffers 52 of odd-numbered gate driving cells GD1, GD3, . . . , GD(n−1). The second floating voltage line SFL applies the second floating voltage Vflt2 at a high voltage level to the even-numbered gate line GL2, GL4, . . . , GLn when the odd-numbered gate driving cells GD1, GD3, . . . , GD(n−1) are tested. To this end, the second floating voltage line SFL is commonly connected to the source electrodes of the NMOS TFTs BMN2 included respectively in the buffers 52 of even-numbered gate driving cells GD2, GD4, . . . , GDn. The driving voltage line FVL, ground voltage line VSL, first floating voltage line FFL and second voltage line SFL are formed side by side between the pixel matrix 22 and the gate driving circuit 46.

The test voltage source 44 switches a test voltage Vtest to be delivered from a test voltage line TVL to the gate lines GD1 to GDn in response to the first and second test control signals Vten and /Vten from the first and second control lines FCL and SCL. To this end, the test voltage source 44 includes n/2 NMOS TFTs TMN1, TMN3, . . . , TMN(n−1) connected to the test voltage line TVL, the first control line FCL and to each odd-numbered gate line GL1, GL3, . . . , GL(n−1), and n/2 NMOS TFTs TMN2, TMN4, . . . , TMNn connected to the test voltage line TVL, the second control line SCL and to each even-numbered gate line GL2, GL4, . . . , GLn. The odd-number NMOS TFTs TMN1, TMN3, . . . , TMN(n−1) are simultaneously turned-on during the period of receiving the first test control signal Vten1 having a high voltage level from the first control line FCL, thereby allowing the test voltage Vtest on the test voltage line TVL to be applied to the odd-numbered gate lines GL1, GL3, . . . , GL(n−1). The first test control signal interval when the even-numbered gate driving cells GD2, GD4, . . . , GDn are driven. Also, the even-number NMOS TFTs TMN2, TMN4, . . . , TMNn are simultaneously turned-on during the period of receiving the second test control signal Vten2 at the high voltage level from the second control line SCL, thereby transmitting the test voltage Vtest on the test voltage line TVL to the even-numbered gate lines GL2, GL4, . . . , GLn. The second test control signal Vten2 remains at the high voltage level during a certain interval when the even-numbered gate driving cells GD2 GD4, . . . , GDn are driven.

The test of the driving circuit is preferably divided into an odd mode for detecting any abnormalities in each odd-numbered gate driving cell GD1, GD3, . . . , GD(n−1) and an even mode for detecting any abnormalities in each even-numbered gate driving cell GD2, GD4, . . . , GDn. This is caused by the act that the n NMOS TFTs TMN1 to TMNn for switching the test voltage Vtest to be applied to the gate lines GL1 to GLn is controlled by the first and second control signals Vten1 and Vten2, and the NMOS TFTs BMN1 and BMN2 of the buffers 52 are separately connected to the first and second floating voltage lines FFL and SFL.

Figure 6:
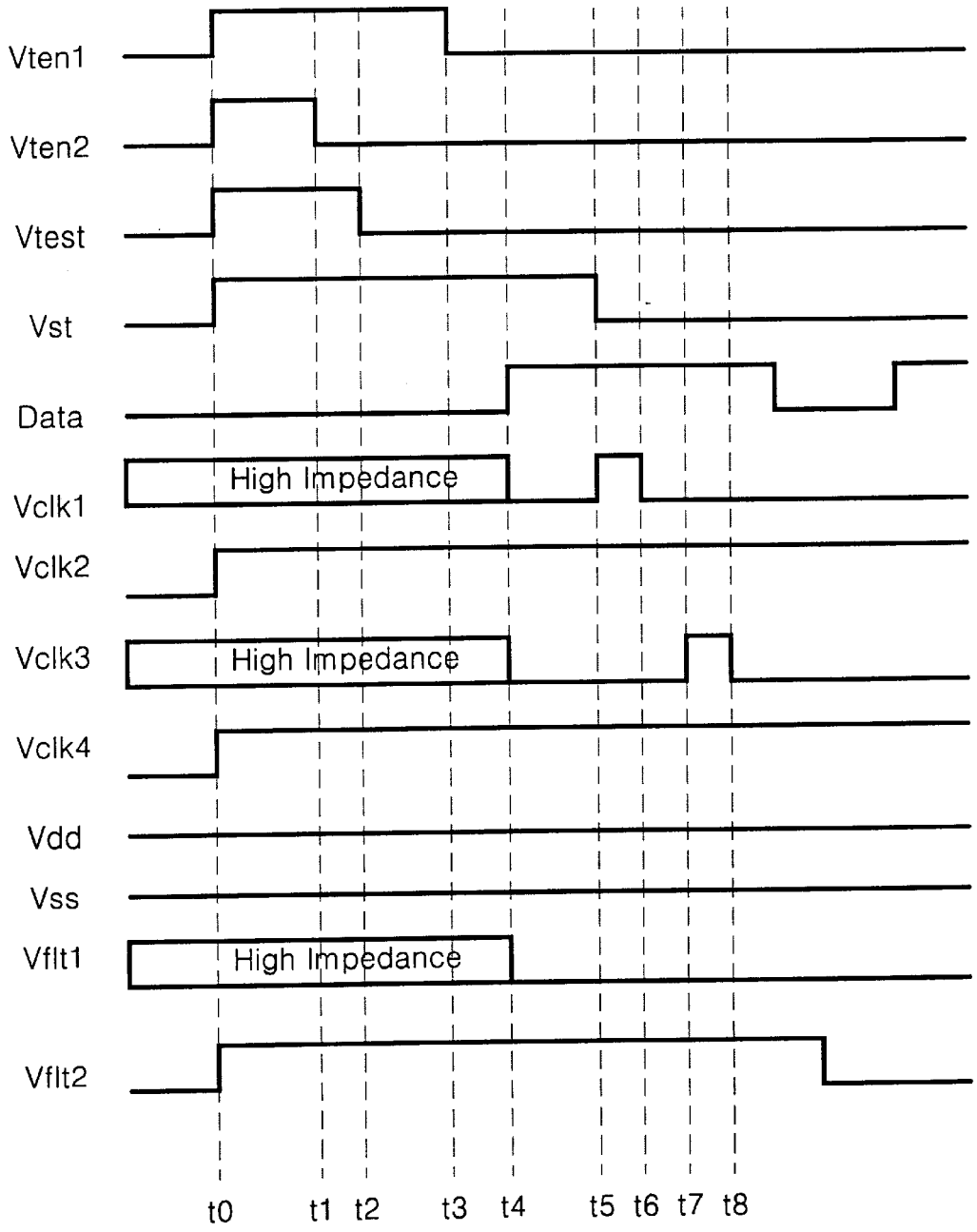
FIG. 6 is an operational waveform diagram of each part of the circuits shown in FIG. 5 when the odd-numbered gate driving cells are tested.

FIG. 6 is a timing chart of signals applied to each part of the liquid crystal display apparatus in FIG. 5 when the odd-numbered gate driving cells GD1, GD3, . . . , GD(n−1) are being tested. Referring to FIG. 6, at t0 the test voltage Vtest on the test voltage line TVL and the first and second test control signals Vten1 and Vten2 applied to the gate of NMOS TFTs TMN1 to TMNn change from a low logic level to a high logic level. Accordingly, all of the NMOS TFTs TMN1 to TMNn are turned on to connect n gate lines GL1 to GLn to the test voltage line TVL. At the same time, the second and fourth clock signal Vclk2 and Vclk4 applied respectively to the second and fourth clock lines CLK2 and CLK4 and the second floating voltage Vflt2 on the second floating voltage line SFL change from the low logic level to the high logic level. Also, the start voltage signal Vst applied to the start signal line SSL goes from the low logic level to the high logic level. At this time, the shift stage 50 included in each even-numbered gate driving cell GD2, GD4, . . . , GDn is reset and the buffer 52 included in each even-numbered gate driving cell GD2, GD4, . . . , GDn receives the second or fourth clock signal Vclk2 or Vclk4 having the high logic level. The NMOS TFT of the buffer 52 included in each even-numbered gate driving cell GD2, GD4, . . . , GDn is turned-off by the second floating voltage having a high logic level to prevent discharging of even-numbered gate lines GL2, GL4, . . . , GLn. The shift stages included in the odd-numbered gate driving cells GD1, GD3, . . . , GD(n−1) are set up by the start voltage signal Vst having a high logic level and the voltage signals on the eveii-numbered gate lines GL2, GL4, . . . , GD(n−2). On the other hand, at t0 the first and third clock signals Vclk1 and Vclk3 on the first and third clock line CLK1 and CLK3 are in a high impedance state. This results in the shift stages 50 included respectively in the odd-numbered gate driving cells GD1, GD3, . . . , GD(n−1) not being reset by the first or third clock signal Vclk1 or Vclk3. Thus, the voltage signals on the odd-numbered gate lines GL1, GL3, . . . , GL(n−1) have a low logic level while the voltage signals on the even-numbered gate lines GL2, GL4, . . . , GLn maintain the high logic level. As a result, the shift stages 50 included in the odd-numbered gate driving cells GD1, GD3, . . . , GD(n−1) are set up while the shift stages 50 of the even-numbered gate driving cells GD2, GD4, . . . , GDn are reset. Next, at t1, the second test control signal Vten2 changes from the high logic level into the low logic level to turn-off the even-numbered NMOS TFTs TMN2, TMN4, . . . , TMNn. The test voltage Vtest on the test voltage line TVL goes from the high logic level to the low logic level at t2. The odd-numbered NMOS TFTs TMN1, TMN3, . . . , TMN(n−1) are tumed-off by the first test control signal Vten1 which changes from the high logic level to the low logic level at t3. At t4, the data driving circuit 24 applies data signals to the data Lines DL1 to DLm. At the same time, the first clock signal Vclk1 on the first clock line CLK1, the third clock signal Vclk3 on the third clock line CLK3 and the first floating voltage Vflt1 on the first floating voltage line FFL are at the low logic level. At t5, the start voltage signal Vst goes from the high logic level to the low logic level while the first clock signal Vclk1 changes from the low logic level to the high logic level. The NMOS TFT of buffer 52 included in each $(4k-3)^{th}$ gate driving cell GD1, GD5, . . . , GD(n−3) applies the first clock signal Vclk1 having a high logic level to the $(4k-3)^{th}$ gate line GL1, GL5, . . . , GL(n−3) to charge the first clock signal having a high logic level in the $(4k-3)^{th}$ gate line GD1, GL5, . . . , GL(n-3) during the time period from t4 to t6. Thus, the cell TFTs CM connected to the $(4k-3)^{th}$ gate lines GL1, GL5, . . . , GL(n−3) are turned-on to charge the data signals in the liquid crystal cells LCC. At this time, the shift stage 50 included in each $(4k-3)^{th}$ gate driving cell GD1, GD5, . . . , GD(n−3) is not reset by the third clock signal Vclk3 having the low logic level. Meanwhile, the shift stage included in each $(4k-1)^{th}$ gate driving cell GD3, GD7, . . . , GD(n−1) is reset by the first clock signal Vclk1 having a high logic level at t5. The shift stage 50 included in each $(4k-1)^{th}$ gate driving cell GD3, GD7, . . . , GD(n−1) is set up again by the voltage signal having a high logic level charged in the $(4k-2)^{th}$ gate line GL2, GL6, . . . , GL(n−2) at t6 when the first clock signal Vclk1 changes from the high logic level to the low logic level. The third clock signal Vclk3 goes from the low logic level to the high logic level at t7 and changes again from the high logic level to the low logic level at t8. The NMOS TFT of buffer 52 included in each $(4k-1)^{th}$ gate driving cell GD3, GD7, . . . , GD(n−1) applies the third clock signal Vclk3 having a high logic level to the $(4k-1)^{th}$ gate line GL3, GL7, . . . , GL(n−1) to charge the third clock signal Vclk3 having a high logic level in the $(4k-1)^{th}$ gate line GL3, GL7, . . . , GL(n−1) during the time period from t7 to t8. Thus, the cell TFTs CM connected to the $(4k-1)^{th}$ gate lines GL3, GL7, . . . , GL(n−1) are turned-on to charge the data signals in the liquid crystal cells LCC. As a result, a picture corresponding to the video data is displayed on a liquid crystal panel. At this time, the shift stage 50 included in each $(4k-1)^{th}$ gate driving cell GD3, GD7, . . . , GD(n−1) is not reset by the first clock signal Vclk1 having the low logic level.

As described above, the shift stage included in the odd-numbered gate driving cells GD1, GD3, GD5, . . . , GD(n−1) respond to the first and third clock signals Vclk1 and Vclk3 and allows the liquid crystal cells LCC connected to the odd-numbered gate lines GL1, GL3, GL5, . . . , GL(n−1) to charge the data signal, thereby driving the pixels connected to the odd-numbered gate lines GL1, GL3, GL5, . . . , GL(n−1). At this time, a tester probes the voltage levels on the odd-numbered gate lines GL1, GL3, . . . , GL(n−1) thereby detecting any abnormalities in each odd-numbered gate driving cell GD1, GD3, . . . , GD(n−1). Alternatively, a tester may detect any abnormalities in each odd-numbered gate driving cell GD1, GD3, . . . , GD(n−1) using a non-probing method, such as an electro-optical method.

Figure 7:
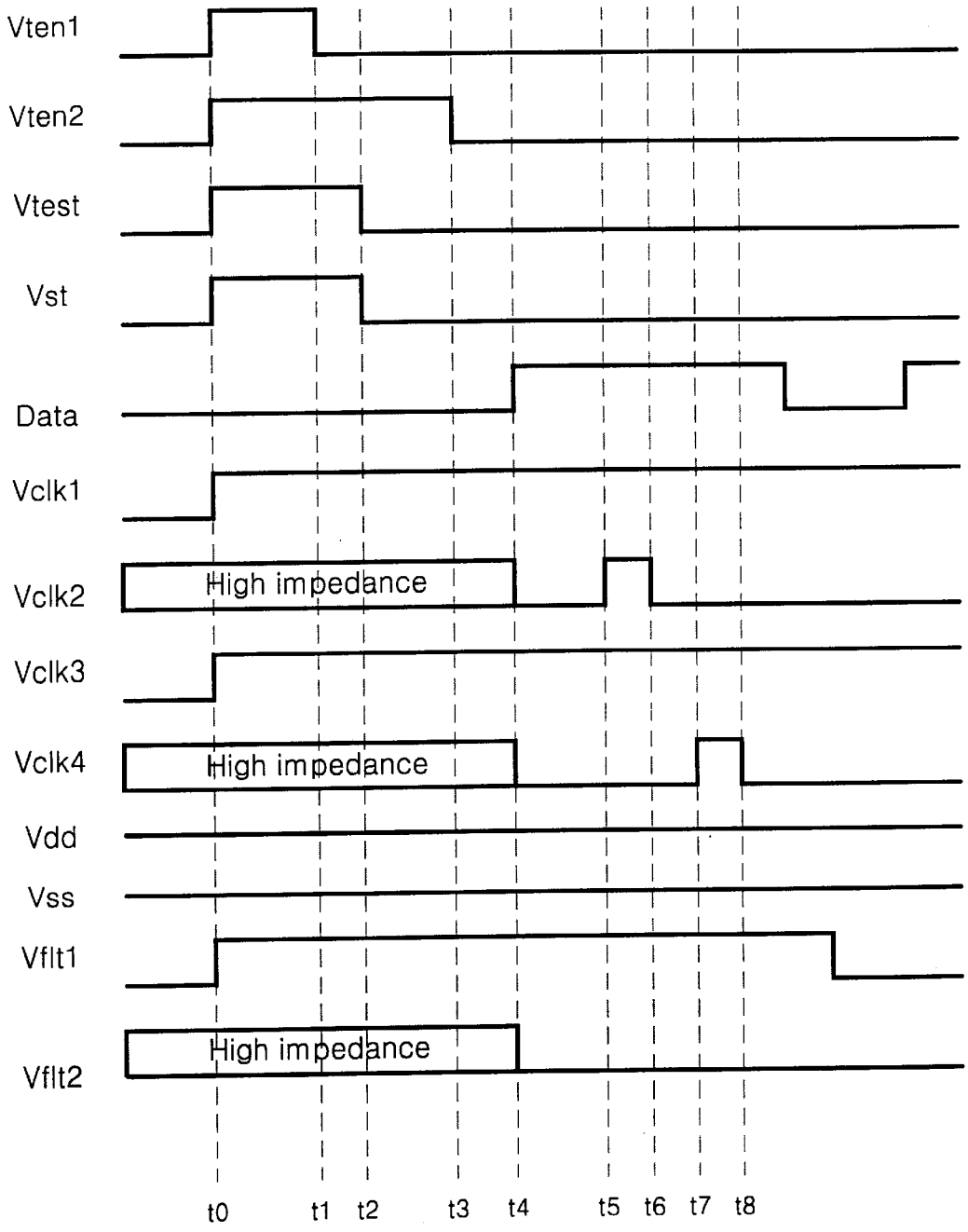
FIG. 7 is an operational waveform diagram of each part of the circuits shown in FIG. 5 when the even-numbered gate driving cells are tested.

FIG. 7 is a timing chart of signals applied to each part of the liquid crystal display apparatus in FIG. 5 when the even-numbered gate driving cells GD2, GD4, . . . , GDn are being tested. Referring to FIG. 7, at t0 the test voltage Vtest on the test voltage line TVL and the first and second test control signals Vten1 and Vten2 applied to the gate of NMOS TFTs TMN1 to TMNn change from a low logic level into a high logic level. Accordingly, all of the NMOS TFTs TMN1 to TMNn are turned-on to connect n gate lines GL1 to GLn to the test voltage line TVL. At the same time, the first and third clock signal Vclk1 and Vclk3 applied respectively to the first and third clock lines CLK1 and CLK3 and the first floating voltage Vflt1 on the first floating voltage line FFL change from the low logic level to the high logic level. Also, the start voltage signal Vst applied to the start signal line SSL goes from the low logic level to the high logic level. At this time, the shift stage 50 included in each odd-numbered gate driving cell GD1, GD3, . . . , GD(n−1) is reset and the buffer 52 included in each odd-numbered gate driving cell GD1, GD3, . . . , GD(n−1) receives the first or third clock signal Vclk1 or Vclk3 having the high logic level. The NMOS TFT of the buffer 52 included in each odd-numbered gate driving cell GD1, GD3, . . . , GD(n−1) is turned-off by the first floating voltage Vflt1 having a high logic level to prevent discharging of the odd-numbered gate lines GL1, GL3, . . . , GL(n−1). The shift stages 50 included in the even-numbered gate driving cells GD2, GD4, . . . , GDn are set up by the voltage signals on the odd-numbered gate lines GL1, GL3, . . . , GD(n−1). On the other hand, at t0 the second and fourth clock signals Vclk2 and Vclk4 on the second and fourth clock line CLK2 and CLK4 are in a high impedance state. This results in the shift stages 50 included in the even-numbered gate driving cells GD2, GD4, . . . , GDn not being reset by the second or fourth clock signal Vclk2 or Vclk4. Thus, the voltage signals on the even-numbered gate lines GL2, GL4, . . . , GLn have the low logic level while the voltage signals on the odd-numbered gate lines GL1, GL3, . . . , GL(n−1) maintain the high logic level. As a result, the shift stages 50 included in the even-numbered gate driving cells GD2, GD4, . . . , GDn are set up while the shift stages 50 of the odd-numbered gate driving cells GD1, GD3, . . . , GD(n−1) are reset. Next, at t1, the first test control signal Vten1 changes from the high logic level to the low logic level to turn-off the odd-numbered NMOS TFTs TMN1, TMN3, . . . , TMN(n−1). The test voltage Vtest on the test voltage line TVL goes from the high logic level to the low logic level at t2. The start voltage signal Vst also changes from the high logic level to the low logic level. The even-numbered NMOS TFTs TMN2, TMN4, . . . , TMNn are turned-off by the second test control signal Vten2 which changes from the high logic level to the low logic level at t3. At t4, the data driving circuit 24 applies data signals to the data lines DL1 to DLm. At the same time, the second clock signal Vclk2 on the second clock line CLK2, the fourth clock signal Vclk4 on the fourth clock line CLK4 and the second floating voltage Vflt2 on the second floating voltage line SFL have the low logic level. The second clock signal Vclk2 changes from the low logic level to the high logic level. The NMOS TFT of buffer 52 included in each $(4k-1)^{th}$ gate driving cell GD2, GD6, . . . , GD(n−2) applies the second clock signal Vclk2 having a high logic level to the $(4k-2)^{th}$ gate line GL2, GL6, . . . , GL(n−2) to charge the second clock signal Vclk2 having a high logic level in the $(4k-2)^{th}$ gate line GL2, GL6, . . . , GL(n−2) during the time period from t4 to t6. Thus, the cell TFTs CM connected to the $(4k-2)^{th}$ gate lines GL2, GL6, . . . , GL(n−2) are turned-on to charge the data signals in the liquid crystal cells LCC. At this time, the shift stage 50 included in each $(4k-2)^{th}$ gate driving cell GD2, GD6, . . . , GD(n−2) is not reset by the fourth clock signal Vclk4 having the low logic level. Meanwhile, the shift stage 50 included in each $(4k)^{th}$ gate driving cell GD4, GD8, . . . , GDn is reset by the second clock signal Vclk2 having a high logic level at t5. The shift stage 50 included in each $(4k)^{th}$ gate driving cell GD4, GD8, . . . , GDn is set up again by the voltage signal having a high logic level charged in the $(4k-1)^{th}$ gate line GL3, GL7, . . . , GL(n−1) at t6 when the second clock signal Vclk2 changes from the high logic level into the low logic level. The fourth clock signal Vclk4 changes from the low logic level to the high logic level at t7 and changes again from the high logic level to the low logic level at t8. The NMOS TFT of buffer 52 included in each $(4k)^{th}$ gate driving cell GD4, GD8, . . . , GDn applies the fourth clock signal Vclk4 having a high logic level to the $(4k)^{th}$ gate line GL4, GL8, . . . , GLn to charge the fourth clock signal Vclk4 having a high logic level in the $(4k)^{th}$ gate line GL4, GL8, . . . , GLn during the time period from t7 to t8. Thus, the cell TFTs CM connected to the $(4k)^{th}$ gate lines GL4, GL8, . . . , GLn are turned-on to charge the data signals in the liquid crystal cells LCC. As a result, a picture corresponding to the video data is displayed on a liquid crystal panel. At this time, the shift stage 50 included in each $(4k)^{th}$ gate driving cell GD4, GD8, . . . , GDn is not reset by the second clock signal Vclk2 having the low logic level.

As described above, the shift stage included in each of the even-numbered gate driving cells GD2, GD4, GD6, . . . , GDn responds to the second and fourth clock signals Vclk2 and Vclk4 and allows the liquid crystal cells LCC connected to the even-numbered gate lines GL2, GL4, GL6, . . . , GLn to charge the data signal, thereby driving the pixels connected to the even-numbered gate lines GL2, GL4, GL6, . . . , GLn. At this time, a tester probes the voltage levels on the even-numbered gate lines GL2, GL4, . . . , GLn thereby detecting any abnormalities in each even-numbered gate driving cell GD2, GD4, . . . , GDn, Any abnormalities in each gate driving cell can be simultaneously detected using the testing process as described. Accordingly, the testing time for the driving circuit is reduced. Also, the gate driving cells GD detected to be abnormal through such a testing process can be repaired at the same time with the redundant gate driving cells RGD.

Figure 8:
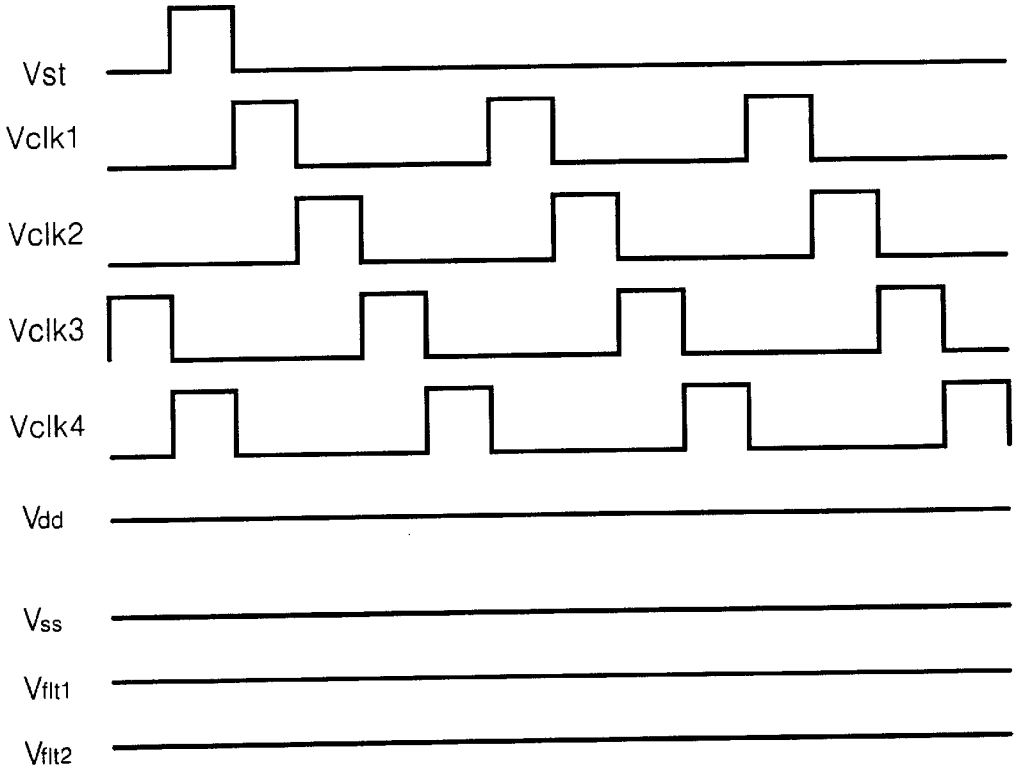
FIG. 8 is a waveform diagram showing signals to be applied to the liquid crystal display apparatus of FIG. 5 in normal operating mode.

FIG. 8 is a timing chart of signals applied to each part of the liquid crystal display apparatus in FIG. 5 when the liquid crystal display apparatus of FIG. 5 is driven normally. Referring to FIG. 8, the gate lines GL1 to GLn are sequentially driven to display the picture corresponding to the video signal. In detail, the start voltage signal Vst having a high logic level is applied to the shift stage 50 of first gate driving cell GD1 before first to fourth clock signals phase-delayed in sequence are applied to the buffers 52 included in the first to fourth gate driving cells GD1 to GD4. At this time, first and second floating voltages Vflt1 and Vflt2 on the first and second floating voltage lines FFL and SFL have a low level VSS. In other words, the first and second floating voltage lines FFL and SFL supply the low level voltage VSS to the source terminals of the NMOS TFTs included in the buffers 52. Also, the test voltage line TVL and the first and second control lines FCL and SCL serve to prevent static electricity by connecting the gate lines GL1 to GLn to the ground GND, (not shown), in the normal operating mode.

As described above, in the apparatus and method of testing the driving circuit according to the present invention, the gate driving cells are driven in such a manner that all or substantial part of the gate lines are simultaneously enabled by the gate driving cells, thereby simultaneously detecting any abnormalities in each gate driving cell. As a result, the apparatus and method of testing the driving circuit according to the present invention is capable of reducing the testing time dramatically as well as reducing the repair time. Further, the apparatus and method of testing the driving circuit according to the present invention can eliminate any difficulties incurred by a testing worker and a repairing worker.

It wil be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for testing a driving circuit of a liquid crystal display having a plurality of gate driving cells connected to a plurality of corresponding gate lines and connected in series to a start signal line, the method comprising:

applying a test signal to the plurality of gate lines;

applying a start signal to a first gate driving cell in the plurality of gate driving cells;

latching the test signal into each gate driving cell;

replacing the test signal applied to the plurality of gate lines with the latched test signals latched into the plurality of gate driving cells; and testing a signal state of each gate line, wherein replacing the test signal further includes turning off the test signal applied to the plurality of gate lines and then applying the latched test signals to the plurality of gate driving cells.

2. The method of claim 1, wherein testing the signal state of each gate line includes detecting voltage levels on the gate lines using a probe.

3. The method of claim 1, wherein testing the signal state of each gate line includes performing an electro-optical test.

4. A method for testing a driving circuit of a liquid crystal display having a plurality of gate driving, cells connected to a plurality of gate lines and connected in series to a start signal line, the method comprising:

applying a test signal to the plurality of gate lines in parallel;

applying a start signal to a first gate driving cell in the plurality of gate driving cells;

latching the test signal into any one of a first group of odd-numbered gate driving cells and a second group of even-numbered gate driving cells among the plurality of gate driving cells;

replacing the test signal with the latched test signals latched into said one of the first group of odd-numbered gate driving cells and the second group of even-numbered gate driving cells; and testing an enable state in each gate line connected to the said one of the first group of odd-numbered gate driving cells and the second group of even numbered gate driving cells, wherein replacing the test signal comprises turning off the test signal applied to the plurality of gate lines and then applying the latched test signals to gate lines corresponding to the said one of the first group of odd-numbered gate driving cells and the second group of even-numbered gate driving cells.

5. The method of claim 4, wherein the test signal is latched into the said one of the first group of odd-numbered gate driving cells and the second group of even-numbered gate driving cells in response to a clock signal.

6. A method for testing a driving circuit of a liquid crystal display having a plurality of gate driving cells connected to a plurality of gate lines and connected in series to a start signal line, the plurality of the gate driving cells driving the plurality of the gate lines in response to four 4-phase clock signals, the method comprising:

applying a test signal to the plurality of gate lines in parallel;

applying a start signal to a first gate driving cell in the plurality of gate driving cells;

setting any one of a first group of odd-numbered numbered gate driving cells and a second group of even-numbered gate driving cells among the plurality of gate driving cells, and resetting a remainder of the plurality of gate driving cells;

applying data signals to the set gate driving cells;

supplying at least one of the 4-phase clock signals to the set gate driving cells to enable the gate lines connected to the set gate driving cells; and testing an enable state in each gate line connected to the set gate driving cells.

7. The method of claim 6, further comprising maintaining voltages on the gate lines connected to the reset gate driving cells at a logical high level.

8. A driving circuit testing apparatus for a liquid crystal display having a plurality of gate driving cells connected to a plurality of gate lines and connected in series to a start signal line, the driving circuit testing apparatus comprising:

means for applying a test signal to the plurality of gate lines;

latching control means for latching the test signal on the plurality of gate lines into each gate driving cell;

signal switching means for replacing the test signal being applied to the plurality of gate lines with the test signal latched into the plurality of gate driving cells; and detecting means for detecting an enable state in each gate line, wherein the signal switching means turns off the test signal applied to the plurality of gate lines and then applies the latched test signal to the plurality of gate lines.

9. The driving circuit testing apparatus of claim 8, wherein the detecting means detects voltage levels in the plurality of gate lines using a probe to test the enable state in each gate line.

10. The driving circuit testing apparatus of claim 8, wherein the detecting means tests the enable state in each gate line using an electro-optical test.

11. A driving circuit testing apparatus for a liquid crystal display having a plurality of gate driving cells connected to a plurality of gate lines and connected in series to a start signal line, the driving circuit testing apparatus comprising:

means for applying a test signal to the plurality of gate lines;

latching control means for allowing the signals on the gate lines to be latched into any one of a first group of odd-numbered gate driving cells and a second group of even-numbered gate driving cells among the plurality of gate driving cells;

signal switching means for replacing the testing signal with the latched test signal latched into the said one of the first group of odd-numbered gate driving cells and the second group of even-numbered gate driving cells; and detecting means for detecting an enable state in each gate line connected to the said one of the first group of odd-numbered gate driving cells and the second group of even-numbered gate driving cells, wherein the signal switching means turns off the test signal applied to the plurality of gate lines and then applies the latched test signal to gate lines corresponding to the said one of the first group of odd-numbered gate driving cells and the second group of even-numbered gate driving cells.

12. The driving circuit testing apparatus of claim 11, wherein the latching control means latches the test signal into the said one of the first group of odd-numbered gate driving cells and the second group of even-numbered gate driving cells in response to a clock signal.

13. The driving circuit testing apparatus of claim 11, wherein the detecting means detects voltage levels on each gate line connected to the said one of the first group of odd-numbered gate driving cells and the second group of even-numbered gate driving cells using a probe to test the enable state in each gate line.

14. The driving circuit testing apparatus as claimed in claim 11, wherein the detecting means tests the enable state in each gate line connected to the said one of the first group of odd-numbered gate driving cells and the second group of even-numbered gate driving cells using an electro-optical testing method.

15. A driving circuit tester for a liquid crystal display having a plurality of gate lines, the driving circuit test comprising:

alternating first and second sets of gate line drivers, each gate line driver being detachable connected to a corresponding gate line, wherein an output of a preceding gate line driver of the first set is connected to an input of a succeeding gate line driver of the second set;

a test signal line connected to the plurality of gate lines for providing a test signal thereto;

a switch serially connected between each one of the plurality of gate lines and the test signal line to control application of the test signal to the plurality of gate lines; and a driver controller connected to the first and second sets of gate line drivers, wherein an input signal of each gate line driver is output as an output signal in response to a driver control signal from the driver controller.

16. A driving circuit tester of claim 15, wherein each gate line driver includes a latch and a buffer serially connected to the latch.

17. A driving circuit tester of claim 16, wherein the driver control signal includes a latch control signal for controlling the latch, and a buffer control signal for controlling an output of the buffer.

18. A driving circuit tester of claim 17, wherein the test signal is provided to the plurality of gate lines when the buffer control signal is at a first logic level, and is not provided when the buffer control signal is at a second logic level.

19. A driving circuit tester of claim 17, wherein the latch control signal is enabled when the test signal is enabled.

20. A driving circuit tester of claim 16, wherein the latch is a shift register.

21. A driving circuit tester of claim 15, wherein the switch includes an n-type transistor and a p-type transistor connected in parallel to each other.

22. A driving circuit tester of claim 15, further including a start signal applied to a first gate line driver among the first and second sets of gate line drivers.

23. A driving circuit tester for a liquid crystal display having a plurality of gate driving cells connected to a plurality of gate lines and connected in series to a start signal line, the plurality of the gate driving cells driving the plurality of the gate lines by four 4-phase clock signals, comprising:

test signal applying means for applying a test signal to the plurality of gate lines in parallel;

start signal applying means for applying a start signal to a first gate driving cell among the plurality of gate driving cells;

a first cell controller for setting any one a first group of odd-numbered numbered gate driving cells and a second group of even-numbered gate driving cells among the plurality of gate driving cells, and resetting a remainder of the plurality of gate driving cells;

data driving means for applying data signals to the set gate driving cells;

a second cell controller for supplying at least one of the 4-phase clock signals to the set gate driving cells to enable each gate line connected to the set gate driving cells, and detecting means for detecting an enable state in each gate line connected to the set gate driving cells.

24. The method of claim 23, further comprising a voltage controller for maintaining voltages on the gate lines connected to the reset gate driving cells at a logical high level.

25. A method for testing a driving circuit of a liquid crystal display having a plurality of gate driving cells connected to a plurality of gate lines and connected in series to a start signal line, the method comprising:

applying a test signal to the plurality of gate lines in parallel;

applying a start signal to a first gate driving cell in the plurality of gate driving cells;

latching the test signal into any one of a first group of odd-numbered gate driving cells and a second group of even-numbered gate driving cells among the plurality of gate driving cells;

replacing the test signal with the latched test signals latched into said one of the first group of odd-numbered gate driving cells and the second group of even-numbered gate driving cells; and testing an enable state in each gate line connected to the said one of the first group of odd-numbered gate driving cells and the second group of even numbered gate driving cells, wherein testing the enable state includes examining a voltage level of said gate line using a probe.

26. A method for testing a driving circuit of a liquid crystal display having a plurality of gate driving cells connected to a plurality of gate lines and connected in series to a start signal line, the method comprising:

applying a test signal to the plurality of gate lines in parallel;

applying a start signal to a first gate driving cell in the plurality of gate driving cells;

latching the test signal into any one of a first group of odd-numbered gate driving cells and a second group of even-numbered gate driving cells among the plurality of gate driving cells;

replacing the test signal with the latched test signals latched into said one of the first group of odd-numbered gate driving cells and the second group of even-numbered gate driving cells; and testing an enable state in each gate line connected to the said one of the first group of odd-numbered gate driving cells and the second group of even numbered gate driving cells, wherein testing the enable state includes performing an electro-optical test.

27. A driving circuit tester for a liquid crystal display having a plurality of gate lines, the driving circuit test comprising:

alternating first and second sets of gate line drivers, each gate line driver being detachable connected to a corresponding gate line, wherein an output of a preceding gate line driver of the first set is connected to an input of a succeeding gate line driver of the second set, each gate line driver including a latch and a buffer serially connected to the latch;

a test signal line connected to the plurality of gate lines for providing a test signal thereto; and a clock signal having first and second logic levels and connected to the latch of each gate line driver, wherein latches for the first set of gate line drivers are triggered when the clock signal is at the first logic level, and latches for the second set of gate line drivers are triggered when the clock signal is at the second logic level;

a driver controller connected to the first and second sets of gate line drivers, wherein an input signal of each gate line driver is output as an output signal in response to a driver control signal from the driver controller.

* * * * *